US007594327B2

(12) United States Patent
Nakayama et al.

(10) Patent No.: US 7,594,327 B2
(45) Date of Patent: Sep. 29, 2009

(54) HEAT EXCHANGER AND METHOD OF MAKING THE SAME

(75) Inventors: Ken Nakayama, Racine, WI (US); David M. Scoville, Kenosha, WI (US)

(73) Assignee: Modine Manufacturing Company, Racine, WI (US)

( * ) Notice: Subject to any disclaimer, the term of this patent is extended or adjusted under 35 U.S.C. 154(b) by 625 days.

(21) Appl. No.: 11/102,938

(22) Filed: Apr. 11, 2005

(65) Prior Publication Data

US 2006/0225871 A1 Oct. 12, 2006

(51) Int. Cl.
*B23P 15/26* (2006.01)
*F28D 1/04* (2006.01)

(52) U.S. Cl. ..... 29/890.054; 165/81; 165/149

(58) Field of Classification Search ..... 165/149, 165/81; 29/890.054
See application file for complete search history.

(56) References Cited

U.S. PATENT DOCUMENTS

| | | | | |
|---|---|---|---|---|
| 1,357,597 | A | 11/1920 | Springer | |
| 3,939,908 | A | 2/1976 | Chartet | |
| 4,289,169 | A | 9/1981 | Banholzer | |
| 4,576,227 | A | 3/1986 | Cadars | |
| 4,719,967 | A | 1/1988 | Scarselletta | |
| 4,721,069 | A | 1/1988 | Kreider | |
| 4,876,778 | A | 10/1989 | Hagihara et al. | |
| 5,174,366 | A | 12/1992 | Nagakura et al. | |
| 5,186,239 | A | 2/1993 | Young et al. | |
| 5,289,873 | A * | 3/1994 | Ryan et al. | 165/149 |
| 5,447,192 | A | 9/1995 | Woerner et al. | |
| 5,613,551 | A | 3/1997 | Rhodes | |
| 5,931,223 | A | 8/1999 | Yu et al. | |
| 5,954,123 | A | 9/1999 | Richardson | |
| 5,992,514 | A | 11/1999 | Sugimoto et al. | |
| 6,012,513 | A * | 1/2000 | Iokawa et al. | 165/149 |
| 6,119,767 | A | 9/2000 | Kadota et al. | |
| 6,129,142 | A * | 10/2000 | Beldam | 165/149 |
| 6,179,050 | B1 * | 1/2001 | Dey et al. | 165/149 |
| 6,328,098 | B1 | 12/2001 | Kodumudi et al. | |
| 6,357,520 | B1 * | 3/2002 | Kato et al. | 165/149 |
| 6,412,547 | B1 | 7/2002 | Siler | |
| 6,502,305 | B2 | 1/2003 | Martins et al. | |
| 6,691,772 | B2 * | 2/2004 | Manaka | 165/149 |
| 2002/0134536 | A1 * | 9/2002 | Nozaki et al. | 165/149 |
| 2005/0016717 | A1 * | 1/2005 | Lamich et al. | 165/149 |
| 2005/0121178 | A1 * | 6/2005 | Nguyen | 165/149 |
| 2007/0256819 | A1 | 11/2007 | Alcaine et al. | |

FOREIGN PATENT DOCUMENTS

| | | |
|---|---|---|
| DE | 19753408 | 6/1999 |

(Continued)

*Primary Examiner*—Leonard R Leo
(74) *Attorney, Agent, or Firm*—Michael Best & Friedrich LLP

(57) ABSTRACT

A side plate for a heat exchanger and method for making a heat exchanger is provided. The side plate includes at least one localized contact point that can be bonded to a header of the heat exchanger during assembly of the heat exchanger. The localized contact point separates from the header under relatively low tension applied by the thermal expansion and contraction of the heat exchanger under normal operating conditions, thereby allowing the tubes of the heat exchanger to expand and contract.

21 Claims, 3 Drawing Sheets

FOREIGN PATENT DOCUMENTS

| | | | | | |
|---|---|---|---|---|---|
| DE | 102005043291 | 11/2007 | | | |
| EP | 0524085 | 1/1993 | | | |
| EP | 0748995 | 12/1996 | | | |
| EP | 1001241 | 5/2000 | | | |
| FR | 2527325 | 11/1983 | | | |
| JP | 1-131898 | 5/1989 | | | |
| JP | 03225197 | A | * | 10/1991 | ..... 165/149 |
| JP | 5-157484 | 6/1993 | | | |

* cited by examiner

HEAT EXCHANGER AND METHOD OF MAKING THE SAME

FIELD OF THE INVENTION

This invention relates to heat exchangers, and in more particular applications, to improved side plates for heat exchangers, as well as methods of making a heat exchanger.

BACKGROUND OF THE INVENTION

Many heat exchangers in use today, such as, for example, vehicular radiators, oil coolers, and charge air coolers, are based on a construction that includes two spaced, generally parallel headers which are interconnected by a plurality of spaced, parallel, flattened tubes. Located between the tubes are thin, serpentine fins. In the usual case, the outer most tubes are located just inwardly of side plates on the heat exchanger and serpentine fins are located between those outer most tubes and the adjacent side plate.

The side plates are typically, but not always, connected to the headers to provide structural integrity. They also play an important role during the manufacturing process, particularly when the heat exchanger is made of aluminum and components are brazed together or when the heat exchanger is made of other materials and some sort of high temperature process is involved in the assembly process.

More particularly, conventional assembly techniques involve the use of a fixture which holds a sandwiched construction of alternating tubes and serpentine fins. The outside of the sandwich, that is the outer layers which eventually become the sides of the heat exchanger core, is typically provided with side plates whose ends are typically connected mechanically to the headers. Pressure is applied against the side plates to assure good contact between the serpentine fins and the tubes during a joining process such as brazing to assure that the fins are solidly bonded to the tubes to maximize heat transfer at their points of contact. If this is not done, air gaps may be located between some of the crests of the fins and the adjacent tube which adversely affect the rate of heat transfer and durability, such as the ability to resist pressure induced fatigue and to withstand elevated pressures.

At the same time, when the heat exchanger is in use, even though the side plates may be of the same material as the tubes, because a heat exchange fluid is not flowing through the side plates but is flowing through the tubes, the tubes will typically be at a higher temperature than the side plates, at least initially during the start up of a heat exchange operation.

This in turn results in high thermal stresses in the tubes and headers. Expansion of the tubes due to relatively high temperatures tends to push the headers apart while the side plates, at a lower temperature, tend to hold them together at the sides of the core. All too frequently, this creates severe thermal stress in the heat exchanger assembly resulting in fracture or the formation of leakage openings near the tube to header joints which either requires repair or the replacement of the heat exchanger.

It has been proposed to avoid this problem, after complete assembly of the heat exchanger, by sawing through the side plates at some location intermediate the ends thereof so that thermal expansion of the tubes is accommodated by the side plates, now in multiple sections, which may move relative to one another at the saw cut. However, this solution adds an additional operation to the fabrication process and consequently is economically undesirable.

It has also been proposed to weaken the intermediate portion of the side plate by placing lines of weakening in the side plate, such as seen in U.S. Pat. No. 6,412,547 to Siler. However, this method requires the additional manufacturing steps of cutting openings and embossing lines of weakening in the side plates.

SUMMARY OF THE INVENTION

In accordance with one form of the invention, a side plate is provided for use with a heat exchanger. The heat exchanger includes a pair of spaced, generally parallel headers, a plurality of spaced, generally parallel tubes extending between and in fluid communication with an interior or the headers and fins extending between the tubes. The side plate includes first and second ends and an intermediate portion. At least one of the ends is shaped to provide at least one localized contact bonded to one of the headers. The intermediate portion has a width and extends between the ends. Each localized contact has a contact width that is less than ⅕ the width of the intermediate portion.

In accordance with one form, a side plate is provided for use with a heat exchanger. The heat exchanger includes a pair of spaced, generally parallel headers, a plurality of spaced, generally parallel tubes extending between and in fluid communication with an interior or the headers and fins extending between the tubes. The side plate includes first and second ends and an intermediate portion. At least one of the ends is shaped to provide at least one localized contact bonded to one of the headers. The intermediate portion has a width and extends between the ends. Each localized contact is sized to separate from the header under relatively low tension applied by the thermal expansion and contraction of the heat exchanger under normal operation conditions.

In one form, each of the first and second ends are shaped to provide at least one localized contact bonded to the headers.

In one form, the first end is V-shaped to provide one localized contacts.

According to one form, the first end is U-shaped to provide two localized contacts.

According to one form, peaks of the fins contact a bottom surface of the side plate.

In accordance with one form, the side plate also includes a tab extending substantially perpendicularly therefrom and contacts a side of the fins.

In one form, the tabs contact serpentine fins.

According to one form, the first end is bonded to a cylindrical header.

In accordance with one form, the localized contact is shaped to provide a line contact with the header.

According to one form, a method is provided for making a heat exchanger. The method includes the steps of:

assembling the components of a heat exchanger core in a fixture to have a pair of spaced parallel headers, spaced tubes extending between the headers, a side plate extending between the headers at a side of the core, and serpentine fins located between adjacent tubes and between the side plate and an outermost one of the tubes;

locating the side plate between the headers overlying an outermost one of said fins by abutting at least one localized contact formed on an end of the plate against one of the headers;

bonding the localized contact to the header during a bonding process for the core; and subjecting the heat exchanger to operating temperatures resulting in the breaking of the bond between the localized contact and the header.

In one form, the bonding step includes bonding the localized contact at each end of the side plate.

Other objects, advantages, and features will become apparent from a complete review of the entire specification, including the appended claims and drawings.

DETAILED DESCRIPTION OF THE PREFERRED EMBODIMENTS

The present invention will be described hereinafter as a vehicular radiator, such as, for example, a radiator for a large truck. However, it should be understood that the invention is applicable to radiators used in other contexts, for example, a radiator for any vehicle or for stationary application as an internal combustion engine driven generator. The invention is also useful in any of the many types of heat exchangers that utilize side plates to hold serpentine fins against parallel tubes extending between spaced headers, such as, for example, oil coolers and charge air coolers. Accordingly, no limitation to any particular use is intended except insofar as expressed in the appended claims.

Figure 1:
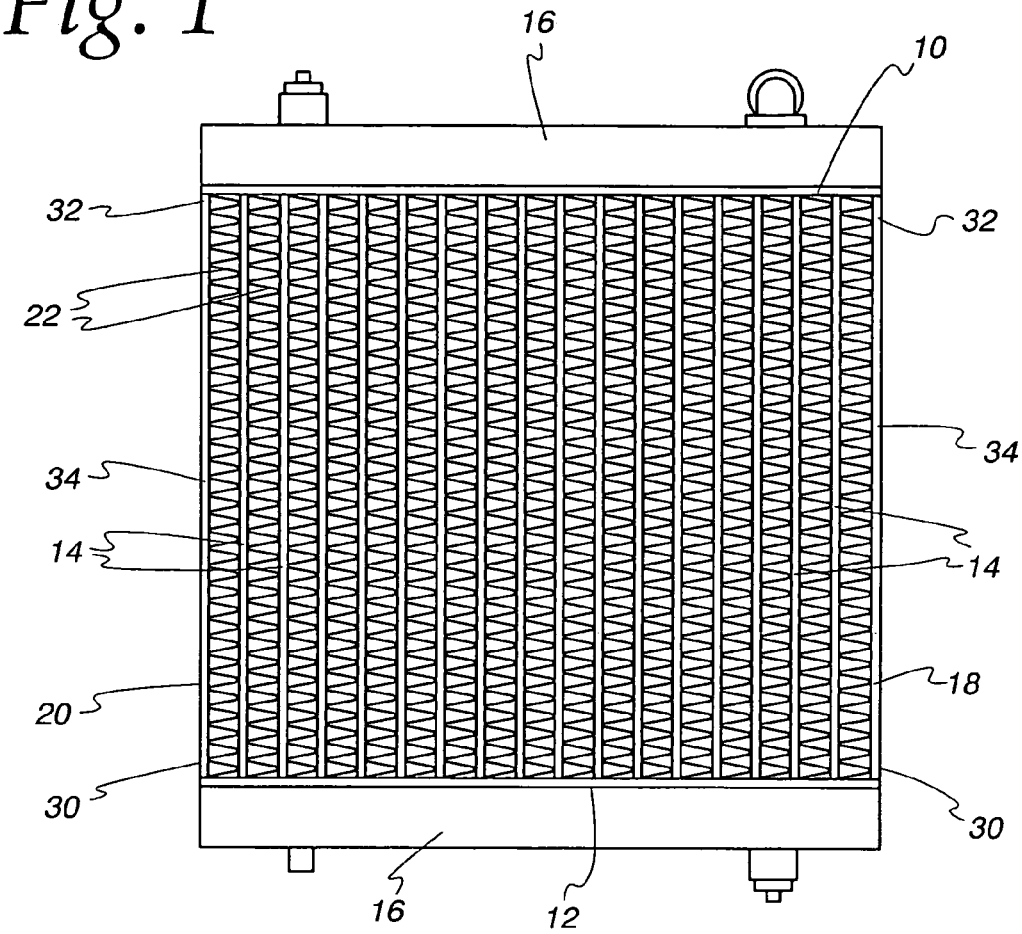
FIG. 1 is a side view of a heat exchanger and side plate assembly.

Referring to FIG. 1, a typical heat exchanger of the type of concerned includes spaced, parallel header plates 10, 12, between which a plurality of flattened tubes 14 extend. The tubes 14 are spaced from one another and their ends are brazed or welded or soldered to and extend through slots, not shown, in the headers 10 and 12 so as to be in fluid communication with the interior of a tank 16 fitted to each of the headers 10, 12. In this regard, it is to be noted that as used herein, the term "header" collectively refers to the header plates 10, 12, to the headers 10, 12 with the tanks 16 secured thereon, or integral header and tank constructions known in the art as, for example, made by tubes or various laminating procedures. Side plates 18, 20 flank respective sides of the heat exchanger construction and extend between the headers 10, 12 and are metallurgically bonded thereto.

Between the spaced tubes 14, and between the endmost tube 14 and an adjacent one of the side plates 18, 20 are ambient air fins, such as conventional serpentine fins 22. However, while conventional serpentine fins 22 are shown, it should be understood that in some applications it may be desirable to use plate fins that extend essentially perpendicular to the longitudinal axes of the tube with the end edges of the plate fins being overlayed by the side plates 18 and 20. As is well known, the fins 22 may be formed of a variety of materials. Typical examples are aluminum, copper and brass. However, other materials can be used as well depending upon the desired strength and heat exchange efficiency requirements of a particular application.

In a highly preferred embodiment of the invention, all of the just described components, with the possible exception of the tanks 16 which may be formed of plastic, are formed of aluminum or aluminum alloy and are braze clad at appropriate locations so that an entire assembly is illustrated in FIG. 1 may be placed in a brazing oven and the components all brazed together. In the usual case, prior to brazing, an appropriate fixture is employed to build up a sandwich made up of the tubes 14 alternating with the serpentine fins 22 and capped at each end by the side plates 18 and 20. The headers 10,12 are fitted to the ends of the tubes 14 so as to allow the tubes 14 to communicate with the interior of the headers 10,12 and/or tanks 16. Specifically, the ends of the tubes 14 may be inserted into openings (not shown) in the headers 10,12 and brazed thereto.

Figure 4:
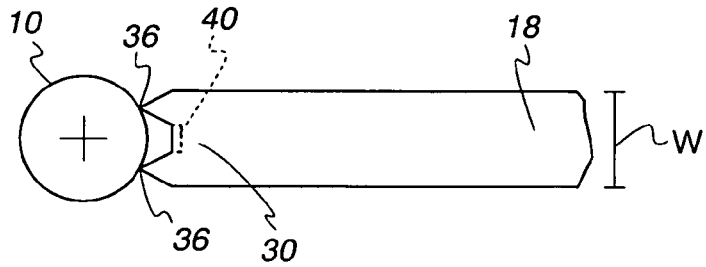
FIG. 4 is a top view of another embodiment of an end of a side plate bonded to a header.
Figure 6:
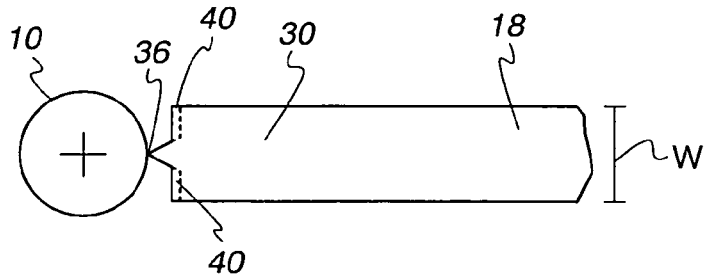
FIG. 6 is a top view of yet another embodiment of an end of a side plate bonded to a header.

Each side plate 18,20 includes first and second ends 30,32 and an intermediate portion 34 extending between the ends 30,32. The intermediate portion preferably has a width W that is the same or nearly the same as the width of the fins 22. At least one of the ends 30,32 is shaped to provide at least one localized contact 36 bonded to one of the headers 10,12, as best seen in FIGS. 2, 4 and 6.

Figure 2:
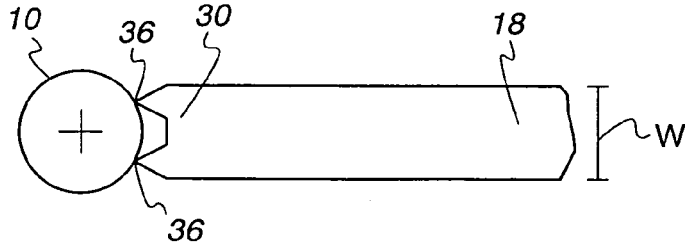
FIG. 2 is a top view an embodiment of an end of a side plate bonded to a header.
Figure 3:
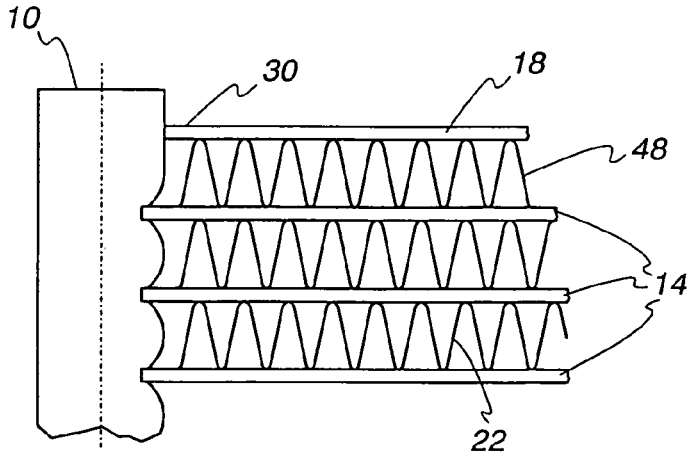
FIG. 3 is a is a side view of FIG. 2.
Figure 5:
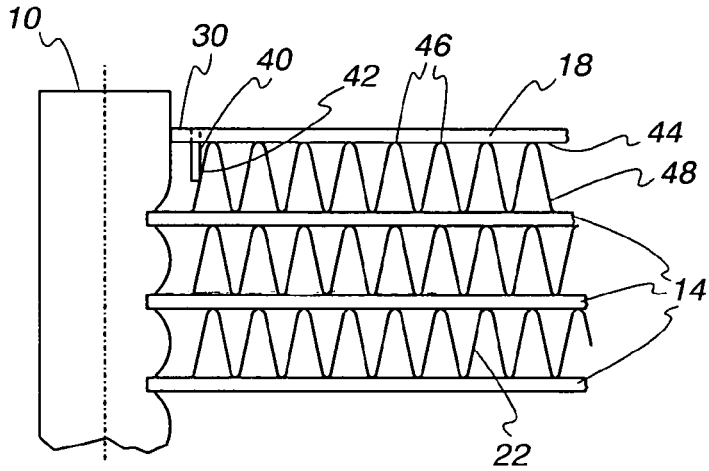
FIG. 5 is a side view of FIG. 4.
Figure 7:
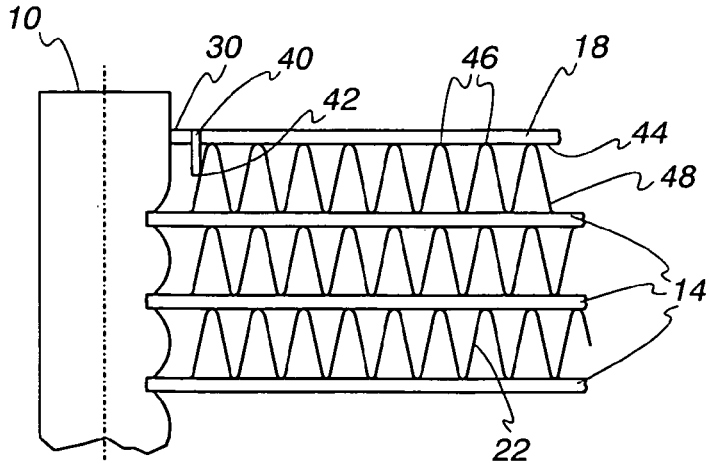
FIG. 7 is a side view of FIG. 6.

Referring to FIG. 2, the end 30 may include more than one localized contact 36. As shown in FIG. 2, two localized contacts 36 are bonded to the header 10. Alternatively, as seen in FIG. 6, there is one localized contact 36 located on the end 30. Each localized contact 36 is bonded to the header 10 through such processes as brazing, soldering, welding and other methods known in the art. The localized contact 36 may be shaped as a point so as to provide a line of contact with the header 10, as best seen in FIGS. 3, 5 and 7.

Figure 8:
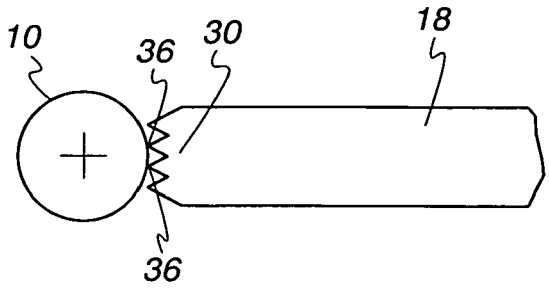
FIG. 8 is a top view of yet another embodiment of an end of a side plate bonded to a header.
Figure 9:
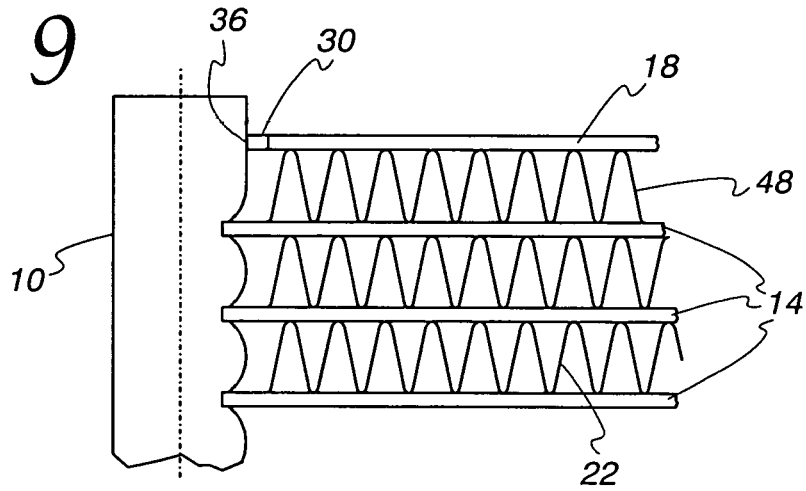
FIG. 9 is a side view of FIG. 8.

Additionally, the ends 30,32 may take a variety of shapes to provide the desired localized contacts 36. For example, in FIG. 6, the end 30 is generally V-shaped whereas in FIG. 2, the end 30 is generally U-shaped. In this regard, it should be appreciated that the U-shaped end 30 in FIG. 2 can provide self-centering of the side plate 18,20 with respect to the corresponding header 10,12 because if the side plate 18,20 is slightly off from center, one of the two prongs of the U-shape will touch the header first and will glide on the header surface until the other point of the U-shaped end 30 touches the header. By way of further example, in FIG. 8, the end 30 has a "multi toothed" or "saw toothed" shape providing four of the point contacts 36, only two of which in the illustrated embodiment actually contact the corresponding header 10,12. Such a design allows for lateral misalignment of the side plate 18,20 to the respective header 10,12 while still ensuring that at least one or more of the point contacts 36 will abut the corresponding header 10,12. This also helps to ensure that the header-to-header spacing or distance is kept within the desired tolerances even when the side plate 18,20 moves laterally during brazing, becoming off-centered. The actual shape of the ends 30,32 and of the associated localized contact(s) 36 can be adjusted as required or desired.

Specifically, the localized contact 36 can be shaped to accommodate a variety of header shapes. Referring to FIG. 2, the header 10 is cylindrical. However, it should be understood by those skilled in the art that the headers 10,12 may take a variety of other shapes and geometries such as rectangular, triangular or other shapes and geometries understood by those skilled in the art.

Furthermore, while FIGS. 2-7 depict only one end 30 of the side plate 18 as having at least one localized contact 36, it should be readily understood by those skilled in the art that both ends 30,32 can be shaped to have at least one localized contact 36 bonded to the respective header 10,12. Similarly, each side plate 18,20 may have each respective first and second ends 30,32 include at least one localized contact 36.

The side plates 18,20 may optionally include one or more tabs 40 to help maintain the position of the fins 22 as seen in FIGS. 4-7. As seen in FIGS. 4 (in phantom) and 5, the tab 40 preferably extends substantially perpendicularly from the side plate 18,20 to retain the fins. The tab 40 contacts a side 42 of the fins 22 while a bottom surface 44 of the side plate 30 contacts peaks 46 of the fins 22. The tab 40 can be used to help maintain the location of outermost ones 48 of fins 22 during assembly. Additionally, multiple tabs 40 can be used as seen in FIGS. 6 (in phantom) and 7.

Figure 10:
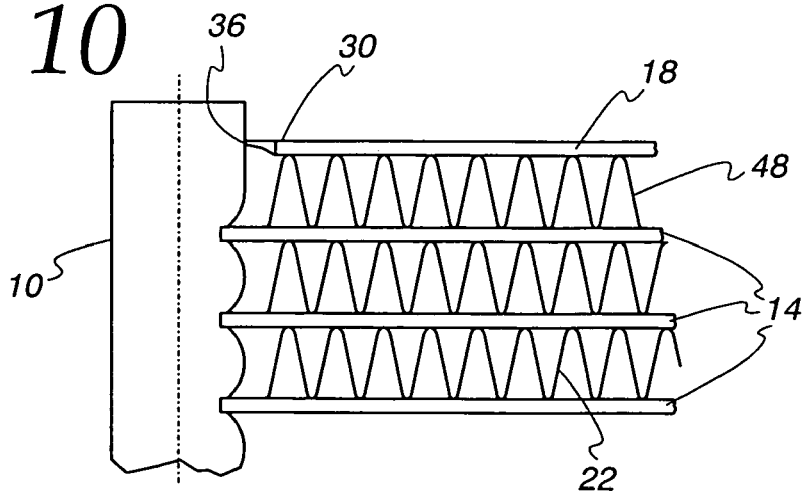
FIG. 10 is a side view similar to FIGS. 3, 5, 7 and 9, but showing an alternate embodiment of an end contact.

During assembly and operation, the localized contacts 36 are intended to be bonded to the respective headers 10,12, but sized to subsequently break that bond and separate from the header during normal operation from relatively low tension applied by the thermal expansion and contraction of the heat exchanger. The localized contacts 36 preferably have a width that is at least less than ⅕ the width W of the intermediate portion 34, and preferably are shaped as a point to provide a line of contact with the header 10, with the length of the line contact being defined by the thickness of the side plate 18,20. As yet a further alternative, the end 30,32 can be coined so as to reduce the local thickness of the side plate 18,20 to provide either a shortened line of contact or, as best seen in FIG. 10, an essentially point contact. The relatively smaller width of the localized contact 36 allows the contact 36 and the respective header 10,12 to separate under the above described operation of the heat exchanger. In this regard, the separation can occur in a number of ways, for example, by breaking of the bond joint between the contact 36 and the respective header 10,12, by breaking of the end 30 at or adjacent the bond joint, or by a combination of these two. This allows the tubes 14 to expand and contract according to temperature changes during normal operation, without binding caused by the side plates 18,20 being joined to the headers 10,12. It should be easily appreciated that it is preferred for the breaking of the bond at the localized contact 36 to occur without damaging the header 10,12 to the point that a leak path is created.

The heat exchanger may be manufactured as discussed below. The main components of the heat exchanger core can be assembled in a fixture (not shown) to hold the core. The headers 10,12 can be placed at opposite ends of the fixture with layers of tubes 14 and fins 22 stacked and located between the headers 10,12. The fins 22 are stacked between adjacent tubes 14. Additionally, fins 22 are located adjacent the top-most and bottom most tubes 14. The side plates 18,20 are located between the headers overlying the outermost ones 48 of the fins 22 by abutting at least one localized contact 36 formed on one of the ends 30,32 of the plate 18,20 against one of the headers 10,12. The localized contact 36 is then bonded to the header 18,20 during a bonding process for the core. Subsequently, the heat exchanger can be subjected to operating temperatures resulting in the breaking of the bond between the localized contact 36 and the header 18,20.

The invention claimed is:

1. A side plate for use with a heat exchanger, the heat exchanger including a pair of spaced, generally parallel headers, a plurality of spaced, generally parallel tubes extending between and in fluid communication with an interior of said headers and fins extending between the tubes, the side plate comprising:

first and second ends, at least one of the ends contoured to provide at least one localized contact bonded to one of the headers and the at least one contoured end being bonded to only an exterior of one of the headers; and an intermediate portion having a width and extending between the ends, wherein each localized contact has a contact width that is less than ⅕ the width of the intermediate portion, and wherein only the each localized contact engages the header to form a break point adjacent the header for separating the side plate and header as a result of thermal expansion and contraction of the heat exchanger.

2. The side plate of claim 1 wherein each of the first and second ends are shaped to provide at least one localized contact bonded to the headers.

3. The side plate of claim 1 wherein the first end is V-shaped to provide one localized contact.

4. The side plate of claim 1 wherein the first end is U-shaped to provide two localized contacts.

5. The side plate of claim 1 wherein the fins contact a bottom surface of the side plate.

6. The side plate of claim 5 further comprising a tab extending substantially perpendicularly therefrom and contacting a side of the fins.

7. The side plate of claim 6 wherein the tab contacts serpentine fins.

8. The side plate of claim 1 wherein the first end is bonded to a cylindrical header.

9. The side plates of claim 1 wherein the localized contact is shaped to provide a line contact or a point contact with the header.

10. The side plate of claim 1 wherein a portion of the at least one localized contact includes a first side and a second side, the first side and the second side converge in a direction from the intermediate portion to the break point.

11. A side plate for use with a heat exchanger, the heat exchanger including a pair of spaced, generally parallel headers, a plurality of spaced, generally parallel tubes extending between and in fluid communication with an interior of said headers and fins extending between the tubes, the side plate comprising:

first and second ends, at least one shaped to provide at least one localized contact bonded to one of the headers; and an intermediate portion having a width overlying an outermost one of said fins, wherein each localized contact is sized to separate from the header under relatively low tension applied by the thermal expansion and contraction of the heat exchanger under normal operating conditions, and wherein the shaped end is tapered to define a point of narrowing such that separation from the header occurs at the point of narrowing.

12. The side plate of claim 11 wherein each of the first and second ends are shaped to provide at least one localized contact bonded to the headers.

13. The side plate of claim 11 wherein the first end is V-shaped to provide one localized contacts.

14. The side plate of claim 11 wherein the first end is U-shaped to provide two localized contacts.

15. The side plate of claim 11 wherein the fins contact a bottom surface of the side plate.

16. The side plate of claim 15 further comprising a tab extending substantially perpendicularly therefrom and contacting a side of the fins.

17. The side plate of claim 16 wherein the tab contacts serpentine fins.

18. The side plate of claim 11 wherein the first end is bonded to a cylindrical header.

19. The side plates of claim 11 wherein the localized contact is shaped to provide a line contact or a point contact with the header.

20. A method of making a heat exchanger comprising the steps of:

assembling the components of a heat exchanger core to have a pair of spaced parallel headers, spaced tubes extending between the headers, a side plate extending between the headers at a side of the core, and fins extend between the tubes and between the side plate and an outermost one of the tubes;

locating the side plate between the headers by abutting at least one localized contact formed on an end of the plate against one of the headers; and bonding the localized contact to the header during a bonding process for the core such that subjecting the heat exchanger to operating temperatures results in separation of the localized contact and the header at the point of contact between the localized contact and the header.

21. The method of claim 20 wherein the bonding step includes bonding the localized contact at each end of the side plate.

* * * * *

UNITED STATES PATENT AND TRADEMARK OFFICE

CERTIFICATE OF CORRECTION

PATENT NO. : 7,594,327 B2
APPLICATION NO. : 11/102938
DATED : September 29, 2009
INVENTOR(S) : Nakayama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 984 days.

Signed and Sealed this

Twenty-eighth Day of September, 2010

David J. Kappos

David J. Kappos
*Director of the United States Patent and Trademark Office*